US005638735A

United States Patent [19]

Ota et al.

[11] Patent Number: 5,638,735

[45] Date of Patent: Jun. 17, 1997

[54] VARIABLE DISPLACEMENT COMPRESSOR

[75] Inventors: Masaki Ota; Hisakazu Kobayashi; Youichi Okadome; Masaru Hamasaki, all of Kariya, Japan

[73] Assignee: Kabushiki Kaisha Toyoda Jidoshokki Seisakusho, Kariya, Japan

[21] Appl. No.: 686,095

[22] Filed: Jul. 24, 1996

[30] Foreign Application Priority Data

Jul. 27, 1995 [JP] Japan ..... 7-191954

[51] Int. Cl.[6] ..... F01B 3/00

[52] U.S. Cl. ..... 92/12.2; 91/505; 403/124; 403/142

[58] Field of Search ..... 92/12.2; 91/504, 91/505, 506, 499; 403/122, 124, 142

[56] References Cited

U.S. PATENT DOCUMENTS

| | | | |
|---|---|---|---|
| 2,513,637 | 7/1950 | Herreshoff et al. | 403/142 |
| 4,061,443 | 12/1977 | Black et al. | 92/12.2 |
| 5,181,453 | 1/1993 | Kayukawa et al. | 92/12.2 |
| 5,382,139 | 1/1995 | Kawaguchi et al. | 91/499 |

FOREIGN PATENT DOCUMENTS 6288347 10/1994 Japan .

*Primary Examiner*—Thomas E. Denion

*Attorney, Agent, or Firm*—Brooks Haidt Haffner & Delahunty

[57] ABSTRACT

A variable displacement compressor that varies its displacement by altering the inclination of a swash plate. A drive shaft is supported rotatably within a housing. A rotor is fixed to the drive shaft. A swash plate is mounted on the drive shaft and adapted to slide and incline with respect to the shaft. A hinge mechanism operably connects the swash plate to the rotor. A plurality of pistons, each accommodated in one of the bores and coupled to the swash plate, are reciprocated in the bore by the rotation of the swash plate. The hinge mechanism includes a guide pin that projects from the swash plate and includes a joint. A support arm projects from the rotor. The support arm includes a receptacle which accommodates the joint and extends toward the drive shaft. A bushing is accommodated within the receptacle and slides along a wall of the receptacle. The bushing is provided with an interior space to accommodate the joint. The interior space allows the joint to pivot therein when the inclination of the swash plate is altered. The bushing is provided with a slit to permit the interior space to be temporarily enlarged when attaching the bushing to the joint.

19 Claims, 5 Drawing Sheets

VARIABLE DISPLACEMENT COMPRESSOR

BACKGROUND OF THE INVENTION

1. Field of the Invention

The present invention relates to variable displacement compressors used in automobile air-conditioning apparatuses.

2. Description of the Related Art

There are a variety of compressors that may be provided to air-condition the passenger's compartment of an automobile. One of these compressors is described in Japanese Unexamined Patent Publication 06-288347. In this publication, a variable displacement compressor shown in FIG. 7 is provided with a hinge mechanism K which allows inclination of a swash plate 14. The hinge mechanism K includes a support arm 17, which projects in a rearward direction from a rotor 16, and a guide pin 18, the basal end of which is fixed to the swash plate 14.

The support arm 17 has a round receptacle 50. The axis of the receptacle 50 extends along an imaginary plane that includes the axis O of a drive shaft 6. A spheric body 18*a* is provided on the distal end of the guide pin 18. The spheric body 18*a* fits into the receptacle 50. The spheric body 18*a* comes into linear contact with the wall of the receptacle 50 as it moves inside the receptacle 50 and pivots with respect to the axis O. This enables inclination of the swash plate 14. When a piston 10 causes suction or compression of gas, a moment acts on the swash plate 14. The moment is carried by the spheric body 18*a*.

The linear contact between the spheric body 18*a* and the wall of the receptacle 50 results in high contact pressure. When the load of the compressor becomes high, alteration of the compressor displacement increases abrasion between the spheric body 18*a* and the wall of the receptacle 50. To reduce such abrasion, the hinge mechanism K is provided with a pair of shoes 40. As shown in FIG. 8, the pair of shoes 40 define a cylindrical body. The cylindrical body is divided axially into halves with each half defining one of the shoes 40. The inner surface of each shoe 40 comes into spheric surface contact with the spheric body 18*a* while the outer surface of each shoe 40 comes into cylindrical surface contact with the wall of the receptacle 50.

Since this structure avoids linear contact, abrasion between the spheric body 18*a* and the wall of the receptacle 50 is reduced. However, the spheric body 18*a* must be retained between the shoes 40 before fitting them into the receptacle 50. Thus, it is required that the shoes 40 retaining the spheric body 18*a* be held either manually or by some sort of holder when assembling them in the receptacle 50. Furthermore, a holder would interfere with the advancement of the shoes 40 in the receptacle 50. As a result, assembly was burdensome.

SUMMARY OF THE INVENTION

Accordingly, it is an object of the present invention to provide a variable displacement compressor provided with a hinge mechanism that suppresses abrasion and simplifies assembling.

To achieve the above object, the present invention provides a variable displacement compressor including a cylinder block provided with a plurality of bores. A housing defines a crank chamber in cooperation with the cylinder block. A drive shaft is supported rotatably in the cylinder block and the housing. A rotor is fixed to the drive shaft in the crank chamber. A swash plate is mounted on the drive shaft and adapted to slide and incline with respect to the shaft. A hinge mechanism operably connects the swash plate to the rotor. A plurality of pistons are each accommodated in one of the bores and coupled to the swash plate to be reciprocated in the bore by the rotation of the swash plate. The compressor displacement is varied by altering the inclination of the swash plate. The hinge mechanism has a guide pin, a support arm, and a bushing. The guide pin projects from the swash plate and includes a joint. The support arm projects from the rotor and includes a receptacle that accommodates the joint and extends toward the drive shaft. The bushing is accommodated within the receptacle and slides along a wall of the receptacle. The bushing has an interior space to accommodate the joint. The interior space allows the joint to pivot therein when the inclination of the swash plate is altered. The bushing is provided with a slit to permit the interior space to be temporarily enlarged when attaching the bushing to the joint.

BRIEF DESCRIPTION OF THE DRAWINGS

The features of the present invention that are believed to be novel are set forth with particularity in the appended claims. The invention, together with objects and advantages thereof, may best be understood by reference to the following description of the presently preferred embodiments together with the accompanying drawings in which:

DETAILED DESCRIPTION OF THE PREFERRED EMBODIMENTS

Figure 1:
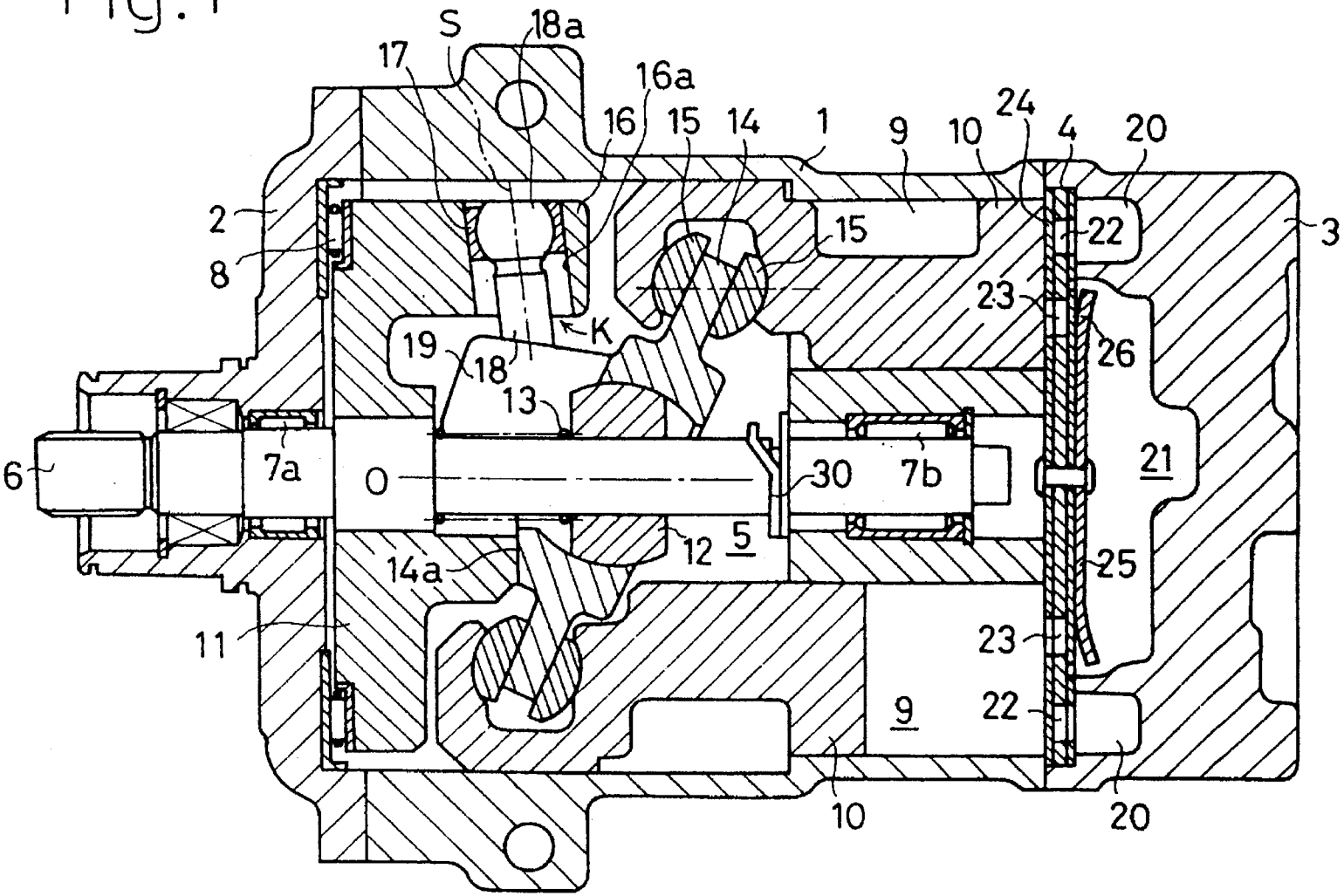
FIG. 1 is a cross-sectional view showing a compressor, which is in a maximum displacement state, according to an embodiment of the present invention.
Figure 2:
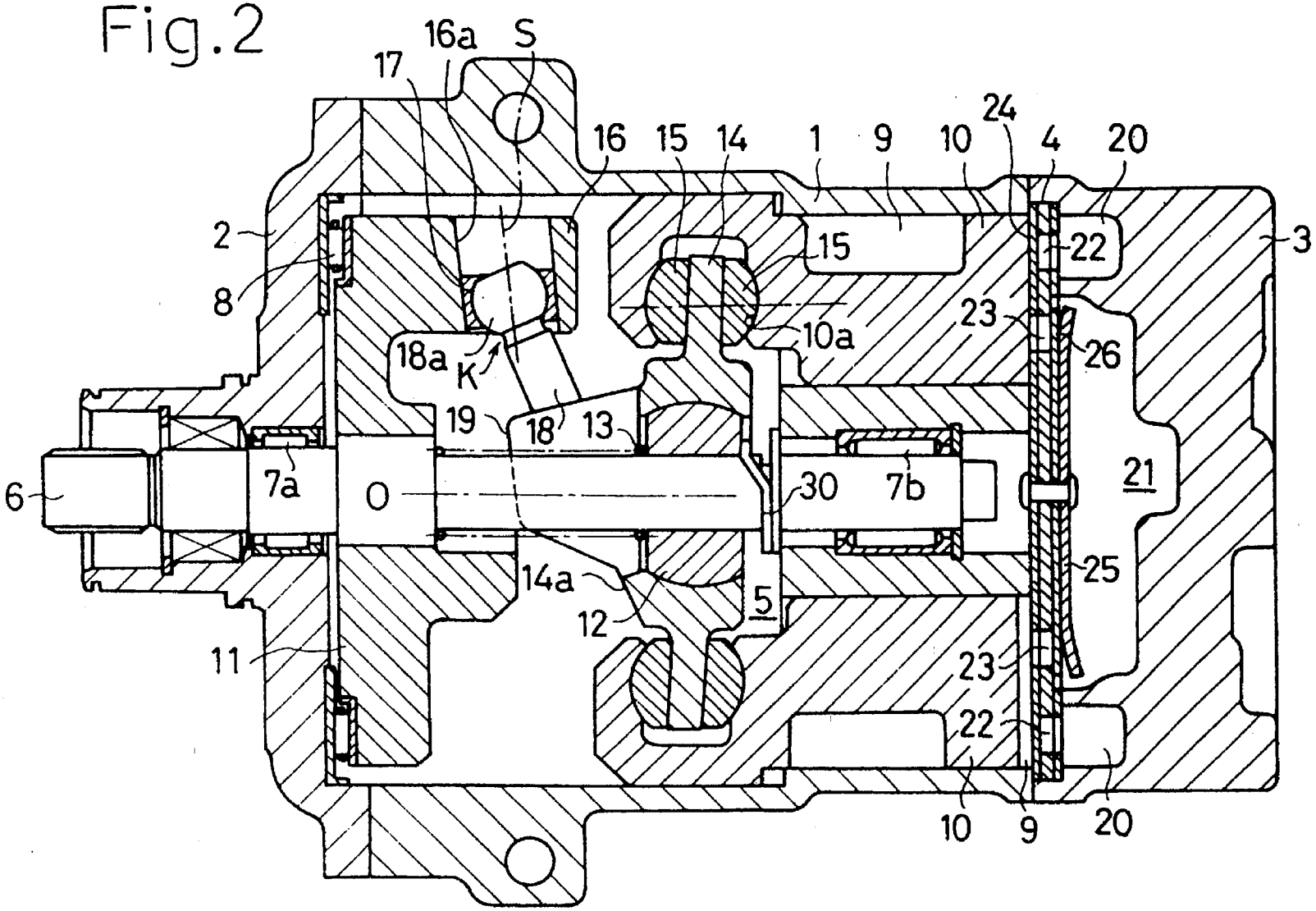
FIG. 2 is a cross-sectional view showing the compressor in a minimum displacement state.

A variable displacement compressor according to an embodiment of the present invention will hereafter be described with reference to the drawings. As shown in FIGS. 1 and 2, a front housing 2 is coupled to the front end of a cylinder block 1 while a rear housing 3 is coupled to the rear end of the block 1 with a valve plate 4 in between. A drive shaft 6 is accommodated in a crank chamber 5, which is defined in the cylinder block 1 and front housing 2. The drive shaft 6 is supported rotatably by bearings 7*a*, 7*b*. A plurality of cylinder bores 9 are provided about the drive shaft 6. A piston 10 is reciprocally accommodated in each bore 9.

A rotor 11 is fixed to the drive shaft 6 in the crank chamber 5. A bearing 8 is arranged between the rotor 11 and the front housing 2. A sleeve 12, which has a convex outer surface, is slidably mounted on the drive shaft 16. A spring 13 is arranged between the rotor 11 and the sleeve 12. The spring 13 urges the sleeve 12 in a rearward direction. A swash plate 14 is pivotally coupled to the sleeve 12. The outer surface of the sleeve 12 allows inclination of the swash plate 14.

As shown in FIG. 1, the maximum inclination position of the swash plate 14 is restricted by the engagement between an abutting surface 14*a*, defined on the front side of the swash plate 14, and the rotor 11. In this state, the spring 13 is contracted between the sleeve 12 and the rotor 11. As shown in FIG. 2, extension of the spring 13 pushes the swash plate 14 and the sleeve 12 in a rearward direction. When the sleeve 12 engages a stopper 30, which is fastened to the drive shaft 6, the swash plate 14 is in its minimum inclination position.

Each piston 10 has a recess, which includes a pair of concave supporting surfaces 10*a*. Each supporting surface 10*a* accommodates a shoe 15. A spherical surface and a flat surface are defined on each shoe 15. The spherical surface of each shoe 15 contacts the associated supporting surface 10*a* and slides therein. The flat surface of each shoe 15 contacts the peripheral surface on the associated side of the swash plate 14 and slides thereon. The rotation of the swash plate 14 is converted to the reciprocation of the pistons 10 by way of the shoes 15.

A hinge mechanism K includes a bracket 19, which projects from the front side of the swash plate 14. The basal end of a guide pin 18 is fixed to the bracket 19. A joint 18*a* is provided on the distal end of the guide pin 18. The joint 18*a* is formed by cutting off part of a spherical body. The hinge mechanism K also includes a support arm 16, which projects from the rear side of the rotor 11 extending parallel with respect to the axis O of the drive shaft 6. A receptacle 16*a* is provided in the distal end of the support arm 16. The axis of the receptacle 16*a* extends along an imaginary plane that includes the axis O of the drive shaft 6. The receptacle 16*a* extends toward the axis O and is inclined as shown in FIG. 2. Thus, the axis of the receptacle 16*a* is closer to the swash plate 14 as it approaches the axis O.

Figure 3:
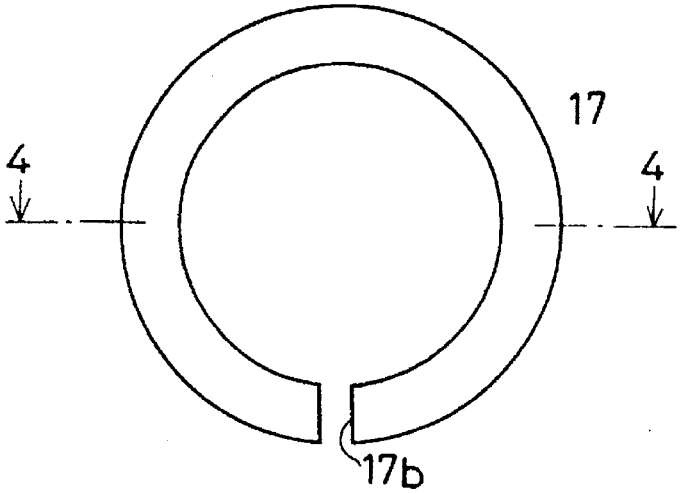
FIG. 3 is a plan view showing a bushing which is used in the compressor.
Figure 4:
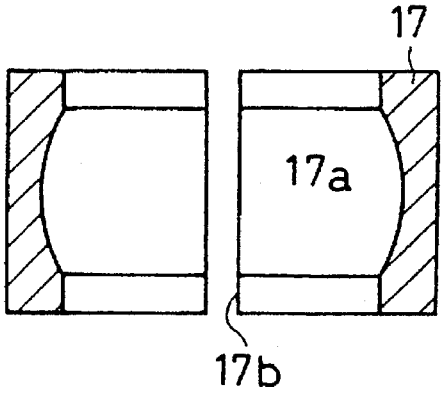
FIG. 4 is a cross-sectional view taken along line 4—4 in FIG. 3.

A bushing 17 is fitted between the joint 18*a* and the receptacle 16*a*. The substantially cylindrical bushing 17 is made from an elastic material such as a steel plate. The outer diameter of the bushing 17 has a dimension chosen such that the bushing 17 may slide along the wall of the receptacle 16*a*. As shown in the enlarged drawing of FIGS. 3 and 4, the bushing 17 has a concave wall 17*a* defined in its inner surface and a slit 17*b*, which extends longitudinally. This structure allows the joint 18*a* to pivot with respect to the drive axis 6. To attach the bushing 17 to the joint 18*a*, the joint 18*a* is engaged to the bushing 17 in a manner such that force is applied to the bushing 17. The force opens the slit 17*b* and causes the interior space of the slit 17*b* to be expanded counteracting the elasticity of the bushing 17. This retains the joint 18 in the bushing 17. The bushing 17 is then inserted into the receptacle 16*a* together with the guide pin 18.

As shown in FIGS. 1 and 2, a suction chamber 20 and a discharge chamber 21 are defined in the rear housing 3. Suction ports 22 and discharge ports 23, each corresponding to one of the bores 9, are formed on the valve plate 4. A compression chamber is defined between each piston 10 and the valve plate 4. The compression chambers are connected to the suction chamber 20 and the discharge chamber 21 through the associated suction and discharge ports 22, 23. Each suction port 22 is provided with a suction valve 24, which selectively opens and closes the port 22 in correspondence with the reciprocation of the associated piston 10. Each discharge port 23 is provided with a suction valve 26, which selectively opens and closes the port 23 in correspondence with the reciprocation of the associated piston 10. The opening action of each suction valve 26 is restricted by a retainer 25. A control valve (not shown) is provided in the rear housing 3 to control the pressure in the crank chamber 5.

When the drive shaft 6, the rotor 11, and the swash plate 14 rotate integrally, the rotating movement is converted to the reciprocating movement of each piston 10 in the associated bore 9 by way of the shoes 15. This causes refrigerant gas to be drawn into the compression chamber from the suction chamber 20. After compression, the refrigerant gas is discharged into the discharge chamber 21. The volume of the refrigerant gas discharged into the discharge chamber 21 is controlled by adjusting the pressure in the crank chamber 5 with the control valve.

In the state shown in FIG. 2, when the control valve decreases the pressure in the crank chamber 5, the back pressure applied to each piston 10 decreases. This causes the swash plate 14 to increase its inclination by pivoting about the sleeve 12. The swash plate 14 simultaneously moves in a forward direction together with the sleeve 12 against the force of the spring 13. As the inclination of the swash plate 14 increases to the state shown in FIG. 1, the stroke of each piston 10 reaches its maximum. This causes the displacement to become maximum. The increase in the inclination of the swash plate 14 causes the joint 18*a* to pivot along the concave wall 17*a* in the bushing 17 and slide the bushing 17 in the receptacle 16*a* in a direction away from the axis O. The joint 18*a* pivots with respect to the sleeve 12 in the clockwise direction of FIG. 2.

In the state shown in FIG. 1, when the control valve increases the pressure in the crank chamber 5, the back pressure applied to each piston 10 increases. This causes the swash plate 14 to decrease its inclination by pivoting about the sleeve 12. The spring 13 simultaneously urges the swash plate 14 in a rearward direction together with the sleeve 12. As the inclination of the swash plate 14 is decreased to the state shown in FIG. 2, the stroke of each piston 10 becomes minimum. This causes the displacement to become minimum. The decrease in the inclination of the swash plate 14 causes the joint 18*a* to pivot along the convex wall 17*a* in the bushing 17 and slide the bushing 17 in the receptacle 16*a* in a direction toward the axis O. The joint 18*a* pivots with respect to the sleeve 12 in the counterclockwise direction of FIG. 1.

As described above, the joint 18*a* maintains spheric surface contact with the concave wall 17*a* when it is pivoted as the inclination of the swash plate 14 is altered. The outer wall of the bushing 17 also maintains cylindrical surface contact with the wall of the receptacle 16*a* as it slides therein. As a result, the bushing 17 reduces abrasion in the hinge mechanism K between the joint 18*a* and the receptacle 16*a* regardless of repetitive alteration of the displacement and high loads.

Additionally, the bushing 17 is formed from a single body with the slit 17*b* that enables the interior space of the bushing to be temporarily expanded. This simplifies the attachment of the joint 18*a* to the bushing 17. Therefore, after attaching the joint 18*a* to the bushing 17, the bushing 17 may easily be inserted into the receptacle 16*a* together with the guide pin 18 without having to support the bushing 17. This facilitates assembly of the mechanism k and leads to an increase in productivity.

Figure 5:
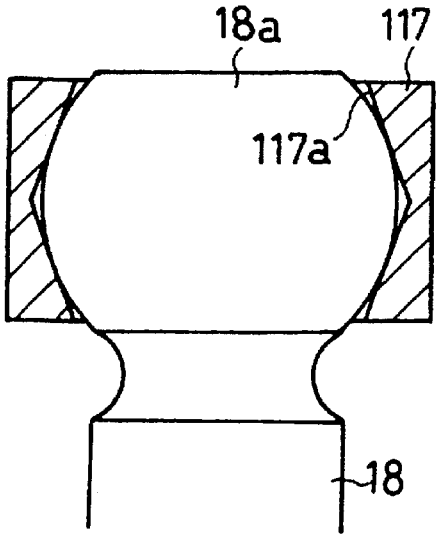
FIG. 5 is a cross-sectional view showing another type of bushing together with a guide pin.

A second embodiment according to the present invention is shown in FIG. 5. A bushing 117 includes a compound conical wall 117*a* defined in its inner wall. The conical wall 117*a* is defined by two conical surfaces that are opposed to each other and intersect. Like the first embodiment, the bushing 117 is split. As apparent from the drawing of FIG. 5, the spherical surface of the joint 18*a* is in linear contact with the conical wall 117*a* at two points. Thus, in comparison with the prior art in which the joint 18*a* comes into linear contact with the spherical surface at only one point, the contact pressure is reduced. Accordingly, abrasion is reduced.

Figure 6:
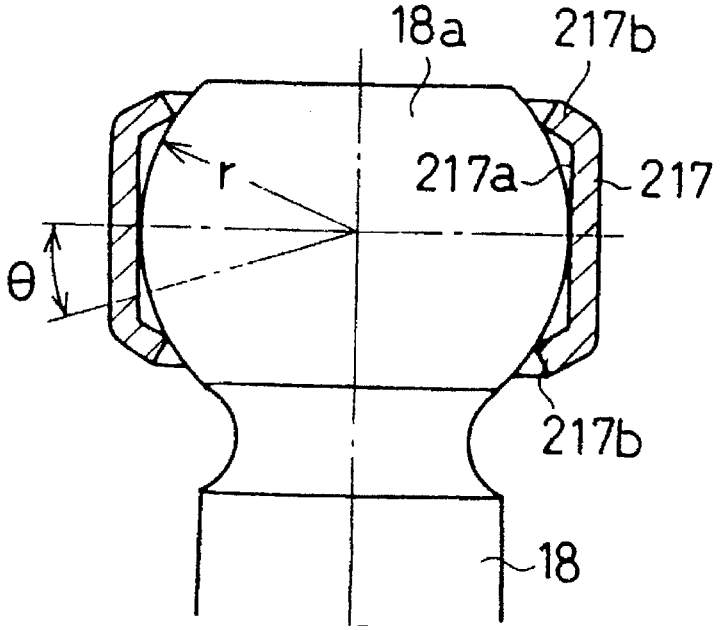
FIG. 6 is a cross-sectional view showing another type of bushing together with the guide pin.
Figure 8:
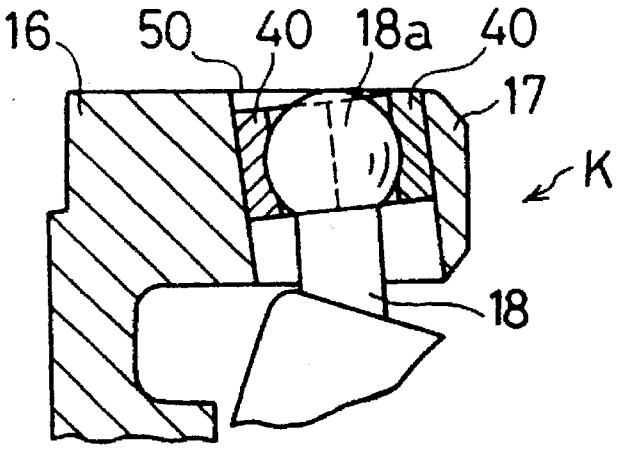
Fig.8 (Prior Art)
FIG. 8 is a partial cross-sectional view showing a prior art guide pin.
Figure 7:
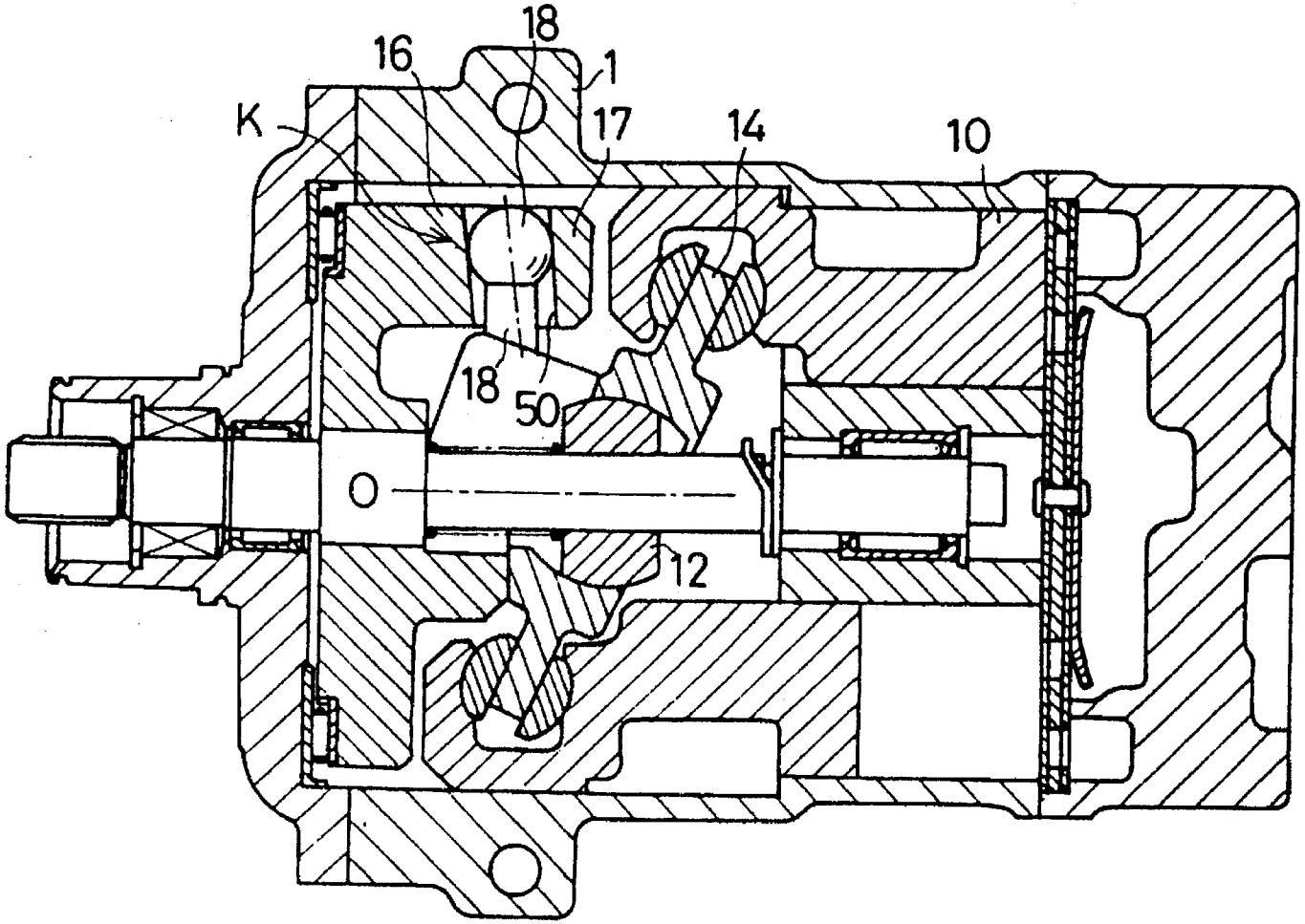
Fig.7(Prior Art)
FIG. 7 is a cross-sectional view showing a prior art compressor.

A third embodiment according to the present invention is shown in FIG. 6. A bushing 217, which pivotally retains the joint 18*a*, is provided with a pair of projecting rims 217*b* projecting inwardly. Like the first embodiment, the bushing 217 is split. Engagement between the joint 18*a* and each projecting rim 217 restricts linear movement of the joint 18*a*. Since the spherical surface of the joint 18*a* makes linear contact with an inner wall 217*a* at one point, as shown in the drawing, there is no difference in contact pressure in comparison with the prior art. However, there is a difference in the sliding amount of the joint 18*a* as compared to the prior art. In the prior art, the sliding amount corresponds to a sum of a component derived from the pivoting of the joint 18*a* about the sleeve 12 and the component derived from the linear movement of the joint 18*a* with respect to the wall of the receptacle 17*a*. In comparison, the sliding amount in this embodiment is reduced to only an amount due to the pivoting of the joint 18*a*. This reduces abrasion on the joint 18*a*.

The approximate sliding distance in this embodiment is represented by $nr\theta/180$. In this representation, r is the diameter of the joint 18*a*. Theta is the pivoting angle of the joint 18*a* with respect to its axis, which is determined in an approximate manner by the pivoting angle of the joint 18*a* with respect to the sleeve 12.

The bushings of the above embodiments may be formed from a single body. This simplifies application of various anti-abrasion processing such as nitrocarburizing. Furthermore, with the structure described in the first embodiment, hardening of the inner wall of the receptacle 16*a* is not required since linear contact is avoided. Accordingly, the rotor 11 may be made from materials such as cast iron. This adds to the types of material which may be employed.

Although only three embodiments of the present invention have been described herein, it should be apparent to those skilled in the art that the present invention may be embodied in many other specific forms without departing from the spirit or scope of the invention. Therefore, the present examples and embodiments are to be considered as illustrative and not restrictive and the invention is not to be limited to the details given herein, but may be modified within the scope of the appended claims.

What is claimed is:

1. A variable displacement compressor comprising:

a cylinder block provided with a plurality of bores;

a housing that defines a crank chamber in cooperation with the cylinder block;

a drive shaft supported rotatably in the cylinder block and the housing;

a rotor fixed to the drive shaft in the crank chamber;

a swash plate mounted on the drive shaft and adapted to slide and incline with respect to the shaft;

a hinge mechanism operably connecting the swash plate to the rotor;

a plurality of pistons, each accommodated in one of the bores and coupled to the swash plate to be reciprocated in the bore by the rotation of the swash plate, wherein the compressor displacement is varied by altering the inclination of the swash plate;

wherein the hinge mechanism includes:

a guide pin that projects from the swash plate and includes a joint;

a support arm that projects from the rotor, wherein the support arm includes a receptacle that accommodates the joint and extends toward the drive shaft;

a bushing accommodated within the receptacle, wherein the bushing slides along a wall of the receptacle, the bushing having an interior space to accommodate the joint, wherein the interior space allows the joint to pivot therein when the inclination of the swash plate is altered, and wherein the bushing is provided with a slit to permit the interior space to be temporarily enlarged when attaching the bushing to the joint.

2. The compressor according to claim 1, wherein said joint is provided at the distal end of the guide pin.

3. The compressor according to claim 2, wherein said joint includes a substantially spherical outer surface.

4. The compressor according to claim 3, wherein the wall of said interior space in said bushing is concave and substantially matches the shape of the joint.

5. The compressor according to claim 3, wherein the wall of said interior space in said bushing is defined by a plurality of conical surfaces, each of which makes linear contact with the joint.

6. The compressor according to claim 3, wherein said bushing is cylindrical and includes projections that project inward from the ends of the bushing, and wherein the projections restrict the linear movement of the joint when the inclination of the swash plate is altered.

7. The compressor according to claim 1, wherein said bushing is formed by pressing a steel plate into a cylindrical shape.

8. The compressor according to claim 1, wherein said support arm is provided at a peripheral section of the rotor, and wherein said receptacle has a longitudinal axis that extends toward the drive shaft in a manner such that it becomes closer to the swash plate as it approaches the drive shaft.

9. A variable displacement compressor comprising:

a cylinder block provided with a plurality of bores;

a housing that defines a crank chamber in cooperation with the cylinder block;

a drive shaft supported rotatably in the cylinder block and the housing;

a rotor fixed to the drive shaft in the crank chamber;

a swash plate mounted on the drive shaft and adapted to slide and incline with respect to the shaft;

a hinge mechanism operably connecting the swash plate to the rotor;

a plurality of pistons, each accommodated in one of the bores and coupled to the swash plate to be reciprocated in the bore by the rotation of the swash plate, wherein the compressor displacement is varied by altering the inclination of the swash plate;

wherein the hinge mechanism includes:

a guide pin that projects from the swash plate and includes a joint provided at its distal end;

a support arm that projects from a peripheral section of the rotor, wherein the support arm includes a receptacle that accommodates the joint and extends toward the drive shaft, the receptacle having a longitudinal axis that extends toward the drive shaft in a manner such that it becomes closer to the swash plate as it approaches the drive shaft;

a bushing accommodated within the receptacle, wherein the bushing slides along a wall of the receptacle, the bushing having an interior space to accommodate the joint, wherein the interior space allows the joint to pivot therein when the inclination of the swash plate is altered, and wherein the bushing is provided with a slit to permit the interior space to be temporarily enlarged when attaching the bushing to the joint.

10. The compressor according to claim 9, wherein said joint includes a substantially spherical outer surface.

11. The compressor according to claim 10, wherein the wall of said interior space in said bushing is concave and substantially matches the shape of the joint.

12. The compressor according to claim 10, wherein the wall of said interior space in said bushing is defined by a plurality of conical surfaces, each of which makes linear contact with the joint.

13. The compressor according to claim 10, wherein said bushing is cylindrical and includes projections that project inward from the ends of the bushing, and wherein the projections restrict the linear movement of the joint when the inclination of the swash plate is altered.

14. The compressor according to claim 9, wherein said bushing is formed by pressing a steel plate into a cylindrical shape.

15. A bushing for use in a variable displacement compressor, wherein the compressor includes:

a cylinder block provided with a plurality of bores;

a housing that defines a crank chamber in cooperation with the cylinder block;

a drive shaft supported rotatably in the cylinder block and the housing;

a rotor fixed to the drive shaft in the crank chamber;

a swash plate mounted on the drive shaft and adapted to slide and incline with respect to the shaft;

a hinge mechanism operably connecting the swash plate to the rotor;

a plurality of pistons, each accommodated in one of the bores and coupled to the swash plate to be reciprocated in the bore by the rotation of the swash plate, wherein the compressor displacement is varied by altering the inclination of the swash plate;

wherein the hinge mechanism includes:

a guide pin that projects from the swash plate and includes a joint;

a support arm that projects from the rotor, wherein the support arm includes a receptacle that accommodates the joint and extends toward the drive shaft;

the bushing comprising:

a ring-like structure having an interior space to accommodate the joint, wherein the interior space allows the joint to pivot therein when the inclination of the swash plate is altered;

a slit to permit the interior space to be temporarily enlarged when attaching the bushing to the joint;

wherein the bushing is accommodated within the receptacle and slides along a wall of the receptacle.

16. The bushing according to claim 15, wherein the wall of said interior space in said bushing is concave and substantially matches the shape of the joint.

17. The bushing according to claim 15, wherein the wall of said interior space in said bushing is defined by a plurality of conical surfaces, each of which makes linear contact with the joint.

18. The bushing according to claim 15, wherein said bushing is cylindrical and includes projections that project inward from the ends of the bushing, and wherein the projections restrict the linear movement of the joint when the inclination of the swash plate is altered.

19. The bushing according to claim 15, wherein said bushing is formed by pressing a steel plate into a cylindrical shape.

* * * * *